United States Patent [19]

Viehrig et al.

[11] 4,344,690

[45] Aug. 17, 1982

[54] ARRANGEMENT FOR TREATING PHOTOGRAPHIC BANDS RUNNING IN PARALLEL PATHS

[75] Inventors: Wolfgang Viehrig, Munich; Viktor Osegowitsch, Taufkirchen; Thomas Hammer, Munich, all of Fed. Rep. of Germany

[73] Assignee: Agfa-Gevaert Aktiengesellschaft, Leverkusen, Fed. Rep. of Germany

[21] Appl. No.: 178,343

[22] Filed: Aug. 14, 1980

[30] Foreign Application Priority Data

Aug. 30, 1979 [DE] Fed. Rep. of Germany ..... 2934984

[51] Int. Cl.[3] ..... G03D 3/13

[52] U.S. Cl. ..... 354/319; 354/321; 242/66; 242/75.51; 226/43; 134/122 P

[58] Field of Search ..... 354/321, 322, 320, 319; 242/66, 75.5, 75.51, 75.52; 226/42, 43; 134/64 P, 122 P

[56] References Cited

U.S. PATENT DOCUMENTS 2,998,175 8/1961 Topping ..... 226/43
3,913,119 10/1975 Pfeifer et al. ..... 226/43
4,099,193 7/1978 Leuchter et al. ..... 354/321
4,181,270 1/1980 Laar et al. ..... 242/75.51

FOREIGN PATENT DOCUMENTS 2729646 1/1979 Fed. Rep. of Germany ..... 354/321

*Primary Examiner*—Richard A. Wintercorn
*Assistant Examiner*—Alan Mathews
*Attorney, Agent, or Firm*—Michael J. Striker

[57] ABSTRACT

An arrangement for treating photographic paper bands which run in parallel paths has at least one treatment station in which the bands are transported with a predetermined speed and treated, winding spools for winding the bands after treating in the treatment station and located downstream of the treatment station, drives for driving the winding spools independently of the transportation of the bands in the treatment station and with a speed exceeding the speed of transportation of the bands in the treatment station, an accumulating station for accumulating the bands between the treatment station and the winding spools so that a loop of the bands is formed in the accumulating station, and a switch for switching the drive on and off in dependence upon a size of the loop of the bands in the accumulating station.

18 Claims, 3 Drawing Figures

ARRANGEMENT FOR TREATING PHOTOGRAPHIC BANDS RUNNING IN PARALLEL PATHS

BACKGROUND OF THE INVENTION

The present invention relates to an arrangement for treating photographic paper bands which run in parallel paths. More particularly, it relates to an arrangement in which the photographic paper bands after passing a wetting station and a drying station, are wound in a winding part onto spools which are supported with their discs on horizontal rollers, wherein at least one roller is connected with a drive which is independent of the transportation of the bands in the machine.

An arrangement of the above mentioned general type is disclosed in the German Offenlegungschrift No. 2,729,646. The winding spools in this arrangement are arranged on two rollers, and the spools allow a lateral shift in axial direction of the rollers for matching to the paper run. Thereby, for each paper path in the winding part a separate drive is provided so that the individual spools with different winding sizes will not mutually negatively affect each other.

The above-described arrangement is substantially suitable for paper bands having the widths of from 12 to 13 cm. However, the development of the copying devices requires today the utilization of paper with the widths from 30 cm and more. The above-described treating arrangement provides for simple matching possibilities in that, for example, two bands of smaller paper widths can be combined so that a paper band of greater width can be treated. The winding spool for this band of greater width lies on two roller pairs with two separate drives which can be synchronized with one another by simple means.

It has been however shown that the weight of the winding rollers for great paper widths so increases that for the spools a lateral shift is no longer possible because of an inclined paper run. As a result of this, the paper with its one side abuts against one spool disc and is curved by the latter until it finally shears off.

SUMMARY OF THE INVENTION

Accordingly, it is an object of the present invention to provide an arrangement for treating photographic paper bands, which with simple means allows winding of greater paper bands with careful treatment of the same.

In keeping with these objects and with others which will become apparent hereinafter, one feature of the present invention resides, briefly stated, in an arrangement in which means for accumulating the bands between a treatment station and winding spools is provided so that a loop of the bands is formed in the accumulating means, switching means is provided for switching driving means which drive winding spools of the bands, in dependence upon a size of the loop of the bands in the accumulating means, and the winding spools are driven independently of the transportation of the bands and with a speed exceeding the speed of transportation of the bands in the treatment station.

When the arrangement is designed in accordance with the present invention, the paper is taken by the winding spools from a loose loop so that an unobjectionable undamaged winding takes place. The substantially loose winding has, from modern point of view, no disadvantages for the subsequent treatment.

Another feature of the present invention resides in that the switching means includes a microswitch arranged to act in response to the weight of a desirable maximum size of the loop.

In accordance with still another feature of the present invention, the loop abuts against a pivotable plate which acts upon the microswitch so as to actuate the same in the operative position of the plate, and a spring is arranged to hold the plate in an inoperative position so that the actuation of the microswitch directly depends upon the loading of the plate by the loop. The plate is pivotably mounted on one of the walls of the housing, and the spring is connected with the plate and another wall to the housing.

Still another feature of the present invention is that the switching means includes a light barrier arranged to act in response to the weight of a desirable maximum loop of the bands.

A further feature of the present invention is that the switching means includes a switching element and an adjustable timing element actuated by the switching element so as to provide for switching on of the driving means during an adjustable predetermined time.

Still a further feature of the present invention is that the driving means is controllable in correspondence with the speed of transportation of the bands, with the utilization of a circuit breaker arranged in a supply conduit of the driving means and switchable by the timing element and/or of a control potentiometer arranged in the supply conduit.

Finally, the winding means may include a wider winding spool composed of two spools and arranged for winding a wider band, and narrower winding spools located adjacent to the wider winding spool and arranged for winding narrower bands, wherein the driving means includes separate drives for the spools, which are arranged to drive the spools synchronically. A tension-dependent loop extending element for the narrower band may be provided, and a switch may be arranged to switch off the loop extending element when the wider band runs over the latter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
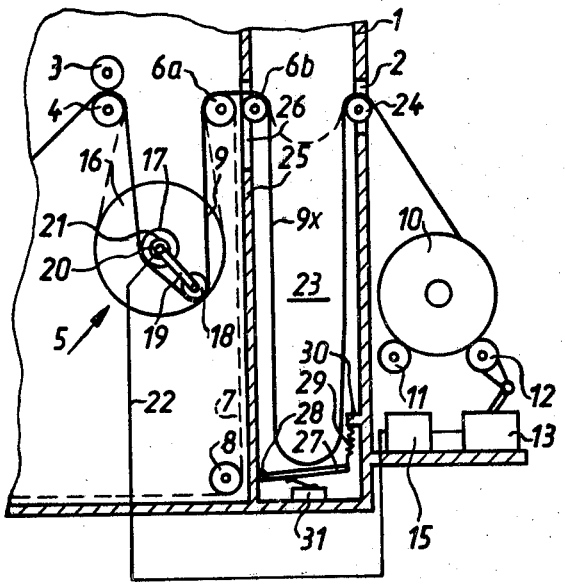
FIG. 1 is a view showing a section of a part of an arrangement for treating photographic paper bands, in accordance with the present invention.

An arrangement for treating photographic paper bands is shown in FIG. 1 and has a housing which is identified by reference numberal 1. An outlet slot 2 is provided in the upper region of the housing and leads to a winding device.

Figure 2:
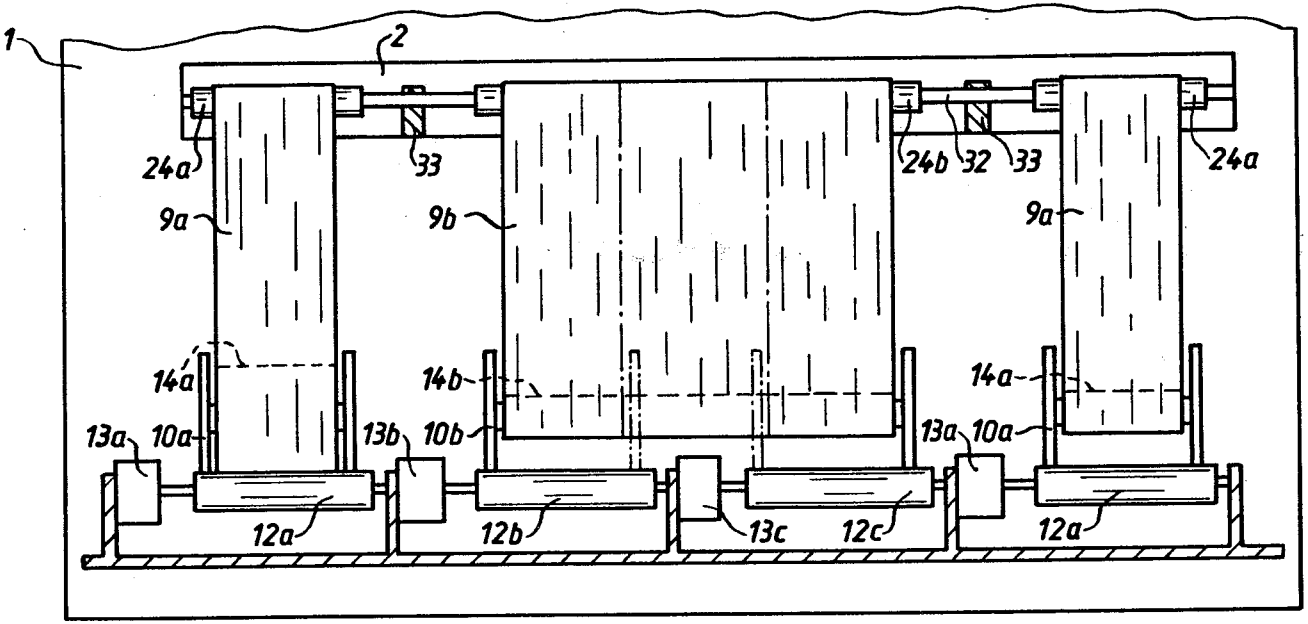
FIG. 2 is a side view of a further amplified embodiment of the arrangement of FIG. 1.

An output part of the arrangement is shown inside the housing. This part includes a pair of transporting rollers 3 and 4, a loop extender 5, a first output roller 6a and a second output roller 6b. The dashed line shows a traction band 7 which runs from the outlet roller 6a over a deviating roller 8 back to an input part of the arrangement. The solid line shows a paper band 9 which runs over both output rollers 6a and 6b into a loop accumulator 23. The band 9 further runs over a deviating roller 24 arranged in the outlet slot 2, to a winding spool 10. The spool 10 rests on two rollers 11 and 12 of which one roller is driven by a motor 13. The connection between the motor 13 and the roller 12 can be indirect via a transmission or direct as shown in FIG. 2. A partition 25 is provided between the output part of the arrangement having the loop extender 5 and the loop accumulator 23. The partition 25 has a cutout 26 through which the band 9 is guided. A light plate 27 is arranged above the bottom of the housing and pivotably mounted on the partition 25. The plate 27 is suspended relative to a pivot point 28 on a pulling spring 29, and the other end of the latter is connected with a stationary projection 30. In the shown inoperative position of the plate 27, the latter directly contacts a spring lever of a microswitch 31 arranged on the bottom of the housing 1. The force of the spring 29 is so selected that the plate 27 is held in the shown position above the microswitch 31. However, under the action of minimum loading, for example, from the loop 9x of the paper band, the plate 27 can be turned about its pivot point 28 and thereby will switch the microswitch 31.

FIG. 2 shows on an insignificantly larger scale a side view of an arrangement in accordance with a special embodiment, which is utilized for treating paper bands of different widths. Small paper bands 9a are wound in the regions of outer paths, whereas a paper band 9b of a double width is wound in the center. The deviating rollers 24a and 24b arranged in the slot 2 are arranged on one axle 32 which is held by several small support members 33.

The smaller paper bands 9a are wound onto spools 10a which rest on rollers 12a driven by motors 13a. The spool which is shown at the left side in the drawing has a relatively great roll 14a, whereas the spool shown at the right side has a smaller roll. The wide paper band 9b is wound in the center onto a respectively great spool 10b. One disc of the spool 10b lies on a roller 12b, whereas the other disc of the spool 10b lies on a roller 12c. The roller 12b is connected with a drive 13b, whereas the roller 12c is connected with a drive 13c. All spools lie on an idle roller 11 which is shown only in FIG. 1.

The dash-dot lines in the region of the greater paper band 9b shows that instead of the great paper band, two small paper bands similar to the outer bands can be wound as well.

Figure 3:
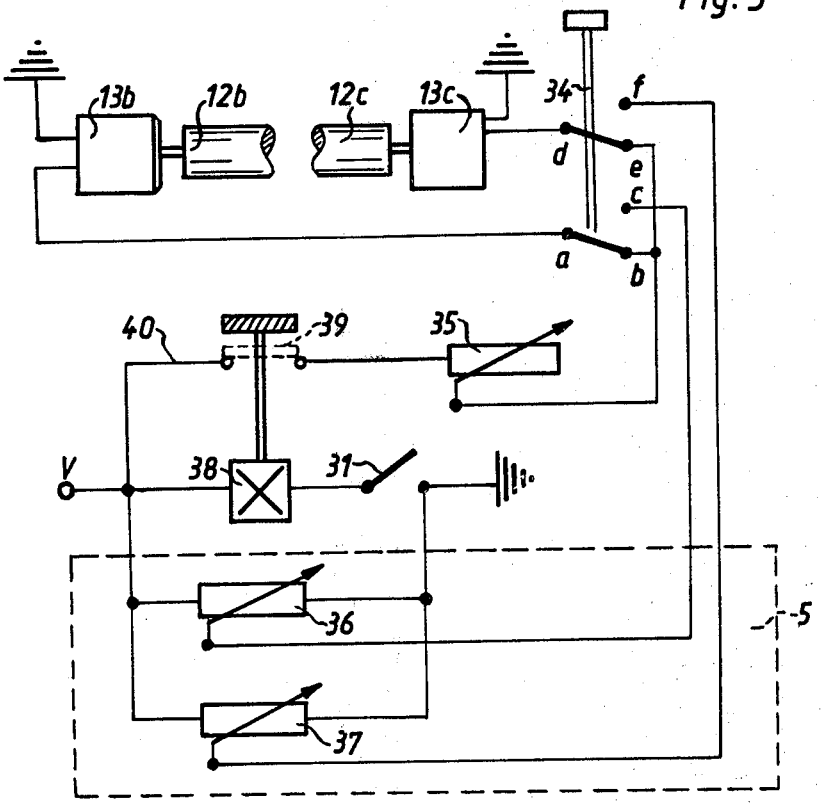
FIG. 3 is a block diagram of control means of the arrangement in accordance with the invention.

FIG. 3 shows a block diagram of a drive control for both drives 13b and 13c. This drive control is provided for switching from the wider band to two small bands. This switching is performed by a switch 34 which in the shown position is set so as to handle the wide band. The two-pole switch 34 connects both shift poles a and d with supply inputs of the drives 13b and 13c. Both contacts b and e of one switching position are combined and located on a collector ring of a potentiometer 35. The other contacts c and f of the second switching position lie separately, each on the collector ring of potentiometers 36 and 37. Both potentiometers 36 and 37 are contained in a loop extending device which will be described hereinafter and their fixed terminals are located between the voltage supply V and mass.

As can be further seen from FIG. 3, the microswitch 31 of the loop accumulator 23 is arranged between the voltage supply V and mass in series with a timing element 38. The timing element 38 controls a circuit breaker 39 which is arranged in a supply conduit 40 between the voltage supply V and a fixed pole of the potentiometer 35.

The arrangement in accordance with the present invention operates as follows:

After the threading of an initial portion of the bands into the spools 10 or 10b, the transportation of the bands through the individual treatment stations starts. When the wide paper band must be processed, the switch 34 is located in the position shown in FIG. 3 in which the potentiometers 36 and 37 do not function. Moreover, the circuit breaker is in its open position, so that the drives 13b and 13c do not operate. When the transportation in the machine takes place, the band 9 moves into the accumulator 23 with the speed V so that a loop 9x is formed. As soon as the loop reaches the plate 27 and the latter is pressed downwardly under the action of the weight of the loop, the switch 31 is closed. With the closing of the switch 31, the timing element 38 is so controlled that it closes the contact of the circuit breaker 39 for a certain preselectable time. When this contact is closed, both drives 13b and 13c are supplied with identical voltage via the potentiometer 35 and the contact b-a and e-d of the switch 34. The drives 13b and 13c are so designed that the circumferential speed of the biggest roller 14b is equal to v+n, that is insignificantly smaller than the speed of transportation inside the machine. This results in that the loop 9x will be further produced.

When the loop 9x starts to discharge, the switch 31 opens, but the timing element 38 continues the supply of the drives 13b and 13c for some time. The time of the timing element 38 is so selected that in condition of the fastest possible withdrawal of the paper from the accumulator, thus with the great roll 14b, the loop 9x is retained in the accumulator 23 at least with the depth of from 20 to 25%. In order to provide matching to different machine speeds, the time of the timing element 38 is adjustable. The speed of the drives 13b and 13c may also be adjusted by the potentiometer 35.

When it is necessary to wind the smaller paper bands, a known arrangement which is also shown in FIG. 1 can be utilized. The traction band 7 runs in the loop extender 5 about a greater roller 16, whereas the paper band 9 runs about a smaller roller 17 and a deviating roller 18. The deviating roller 18 is mounted on an end portion of a lever 19. The other end of the lever 19 pivots about an axle 20 which also supports the rollers 16 and 17. A potentiometer 21 corresponding to the potentiometers 36 and 37 of FIG. 3 is arranged on the axle 20. The terminals of the potentiometer 21 can be actuated via the lever 19. As can be further seen from FIG. 1, a control arrangement 15 may be provided between the potentiometer 21 and the drive 13. The control arrangement 15 converts the taking of voltage drop into a respective voltage supply for the drive.

In operation in condition of greater spool roller or greater pulling action of the paper band 9 because of the greater winding diameter, the lever 19 gradually rotates about the axle 20 in the counterclockwise direction. With the rotation of the lever 19, the potentiometers 21 or 36 are actuated and the variations of their characteristics are transmitted to the control arrangement 15 or the drive 13*b* and the drive speed of the motor reduces.

With the aid of the loop extender 5, the band is wound with a predetermined tension, which in accordance with the invention in the case of the wider paper bands must be avoided. The switch 34 allows easy switching of the control from small band operation to wide band operation.

It is to be understood that the sensing of the loop 9*x* in the accumulator can be performed by other elements, such as for example a light barrier. It is also to be realized that instead of the timing element 38, a second light barrier in upper region of the accumulator may be provided, which senses the minimum loop and actuates the circuit breaker 39.

It will be understood that each of the elements described above, or two or more together, may also find a useful application in other types of constuctions differing from the types described above.

While the invention has been illustrated and described as embodied in an arrangement for treating photographic paper bands, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for treating photographic paper bands which run in parallel paths, comprising means for treating the bands and forming at least one treatment station in which the bands are transported with a predetermined speed and treated; means for winding the bands after treating in said treatment station and located downstream of said treatment station; means for driving said winding means independently of the transportation of the bands in said treatment station and with a speed exceeding the speed of transportation of the bands in said treatment station; means for accumulating the bands between said treatment station and said winding means so that a loop of the bands is formed in said accumulating means; means for switching said driving means on and off in dependence upon a size of the loop of the bands in said accumulating means, said switching means including a microswitch arranged to act in response to the weight of a desirable maximum size of the loop; a pivotable plate against which the loop can abut and which, in turn, acts upon said microswitch so as to actuate the same in an operative position of said plate; and a spring arranged to hold said plate in an inoperative position so that the actuation of said microswitch directly depends upon the loading of said plate by the loop.

2. An arrangement as defined in claim 1; and further comprising a housing accommodating said means and having a plurality of walls, said plate being pivotally mounted on one of said walls of said housing.

3. An arrangement as defined in claim 2, wherein said spring has a first end portion connected with said plate and a second end portion connected with another wall of said housing.

4. An arrangement for treating photographic paper bands which run in parallel paths, comprising means for treating the bands and forming at least one treatment station in which the bands are transported with a predetermined speed and treated; means for winding the bands after treating in said treatment station and located downstream of said treatment station; means for driving said winding means independently of the transportation of the bands in said treatment station and with a speed exceeding the speed of transportation of the bands in said treatment station; means for accumulating the bands between said treatment station and said winding means so that a loop of the bands is formed in said accumulating means; and means for switching said driving means on and off in dependence upon a size of the loop of the bands in said accumulating means, said switching means including a switching element and a timing element actuated by said switching element so as to provide for switching on of said driving means during a predetermined time.

5. An arrangement as defined in claim 4, wherein said timing element is adjustable so that said driving means can be switched on during an adjustable time.

6. An arrangement as defined in claim 4, wherein said driving means is controllable in correspondence with the speed of transportation of the bands; and further comprising means for controlling said driving means.

7. An arrangement as defined in claim 6; and further comprising a supply conduit for said driving means, said controlling means including a circuit breaker arranged in said supply conduit and switchable by said timing element.

8. An arrangement as defined in claim 6; and further comprising a supply conduit for said driving means, said controlling means including a control potentiometer arranged in said supply conduit.

9. An arrangement as defined in claim 7, wherein said controlling means further includes a control potentiometer arranged in said supply conduit.

10. An arrangement for treating photographic paper bands which run in parallel paths, comprising means for treating the bands and forming at least one treatment station in which the bands are transported with a predetermined speed and treated; means for winding the bands after treating in said treatment station and located downstream of said treatment station, said winding means including a wider winding spool composed of two winding spools and arranged for winding a wider band, and narrower winding spools located adjacent to said wider winding spool and arranged for winding narrower bands; means for driving said winding means independently of the transportation of the bands in said treatment station and with a speed exceeding the speed of transportation of the bands in said treatment station, said driving means including drives for said spools and being arranged to drive said spools synchronically; means for accumulating the bands between said treatment station and said winding means so that a loop of the bands is formed in said accumulating means; means for switching said driving means on and off in dependence upon a size of the loop of the bands in said accumulating means; and a tension-dependent loop extending element for the narrower band, and a switch arranged to switch off said loop extending element when the wider band runs over the latter.

11. An arrangement for treating photographic paper bands which run in parallel paths, comprising means for treating the bands and forming at least one treatment station in which the bands are transported with a predetermined speed and treated; means for winding the bands after treating in said treatment station and located downstream of said treatment station; means for accumulating the bands between said treatment station and said winding means so that a loose loop of the bands is formed in said accumulating means; means for driving said winding means independently of the transportation of the bands in said treatment station and with a speed exceeding the speed of transportation of the bands in said treatment station; and means for switching said driving means on and off in dependence upon a size of the loose loop of the bands in said accumulating means.

12. An arrangement as defined in claim 11, wherein said treating means further forms a preceding treatment station located upstream of said first-mentioned station, said preceding treatment station being a wetting station and said first-mentioned treatment station being a drying station, said driving means being arranged to drive said winding means with a speed which exceeds the speed of transportation of the bands in each of said treatment stations.

13. An arrangement as defined in claim 11, wherein said winding means includes spools each provided with discs supported on horizontal rollers, said driving means being arranged for independently driving at least one of said rollers.

14. An arrangement as defined in claim 11, wherein said switching means includes a microswitch arranged to act in response to the weight of a desirable maximum size of the loop.

15. An arrangement as defined in claim 11, wherein said switching means includes a light barrier arranged to act in response to the weight of a desirable maximum loop of the bands.

16. An arrangement as defined in claim 11, wherein said winding means includes a wider winding spool composed of two winding spools and arranged for winding a wider band, and narrower winding spools located adjacent to said wider winding spool and arranged for winding narrower bands, said driving means including drives for said spools and being arranged to drive said spools synchronically.

17. An arrangement as defined in claim 16, wherein said winding spools of said wider winding spool have axes and are located axially adjacent to one another.

18. An arrangement as defined in claim 16, wherein said wider winding spool has a predetermined width, said winding spools of said wider winding spool being spaced from one another by a distance corresponding to said width.

* * * * *